US009351619B2

(12) United States Patent
Bosses

(10) Patent No.: US 9,351,619 B2
(45) Date of Patent: May 31, 2016

(54) DUAL SUCTION VACUUM CLEANER

(71) Applicant: Zenith Technologies, LLC, Boca Raton, FL (US)

(72) Inventor: Mark D. Bosses, Boca Raton, FL (US)

(73) Assignee: Zenith Technologies, LLC, Fort Lauderdale, FL (US)

( * ) Notice: Subject to any disclaimer, the term of this patent is extended or adjusted under 35 U.S.C. 154(b) by 221 days.

(21) Appl. No.: 14/069,977

(22) Filed: Nov. 1, 2013

(65) Prior Publication Data

US 2014/0123434 A1 May 8, 2014

Related U.S. Application Data

(60) Provisional application No. 61/721,922, filed on Nov. 2, 2012.

(51) Int. Cl.

| | |
|---|---|
| ***A47L 9/04*** | (2006.01) |
| ***A47L 5/30*** | (2006.01) |
| ***A47L 9/00*** | (2006.01) |

(52) U.S. Cl.

CPC ..... *A47L 9/0483* (2013.01); *A47L 5/30* (2013.01); *A47L 9/0081* (2013.01); *A47L 9/0461* (2013.01); *A47L 9/0466* (2013.01)

(58) Field of Classification Search

CPC ..... A47L 5/30; A47L 9/0483; A47L 9/0461; A47L 9/0466

USPC ..... 15/379, 382

IPC ..... A47L 5/30, 9/04

See application file for complete search history.

(56) References Cited

U.S. PATENT DOCUMENTS

| | | | | |
|---|---|---|---|---|
| 2,932,504 | A | 4/1960 | Lichtgarn | |
| 4,408,366 | A * | 10/1983 | Goldsmith | 15/321 |
| 5,400,466 | A | 3/1995 | Alderman | |
| 5,471,695 | A * | 12/1995 | Aiyar | 15/22.1 |
| 6,108,853 | A | 8/2000 | Dittus | |
| 6,161,251 | A | 12/2000 | Lee | |
| 7,143,470 | B2 | 12/2006 | Bosses | |
| 7,225,505 | B2 | 6/2007 | Bosses | |

* cited by examiner

*Primary Examiner* — David Redding

(74) *Attorney, Agent, or Firm* — Global IP Counselors, LLP

(57) ABSTRACT

A vacuum cleaner includes a base, and a mechanical beater and a vibrating member connected thereto. A first suction inlet in the base is associated with the mechanical beater. A second suction inlet in the base is associated with the vibrating member. An airflow path is in fluid communication with the first and second suction inlets and flows to a debris collector.

20 Claims, 7 Drawing Sheets

DUAL SUCTION VACUUM CLEANER

CROSS REFERENCE TO RELATED APPLICATION

This application claims the benefit under 35 U.S.C. §119 (e) of U.S. Provisional Application Ser. No. 61/721,922, filed Nov. 2, 2012, which is hereby incorporated by reference in its entirety.

FIELD OF THE INVENTION

The present invention relates to a vacuum cleaner having dual suction. More particularly, the present invention relates to a vacuum cleaner having dual suction and a vibrating member to facilitate removing dirt and debris from a surface to be cleaned. Still more particularly, the present invention relates to a vacuum cleaner having a first suction inlet through a brush roll and a second suction inlet through a vibrating member to facilitate removing dirt from a surface to be cleaned.

BACKGROUND OF THE INVENTION

Vacuum cleaners typically use a suction nozzle that is movable across a surface to be cleaned. The suction created at an inlet in the nozzle results in the removal of free dirt particles accumulated on the surface. However, ground in dirt is frequently encountered when cleaning carpets or other textured surfaces, and reliance on suction for removal of such ground-in dirt has proven to be unsatisfactory.

Accordingly, effort has been made to provide vacuum cleaners with an effective means to beat the carpet surface to dislodge ingrained dirt particles. Such beaters are often located on the vacuum cleaner nozzle head, so that dirt can be dislodged and instantly removed by simply moving the nozzle head across a soiled carpet surface. The earliest known beaters are mechanical beaters, which physically strike the carpet surface to loosen dirt particles.

An example of a mechanical beater is disclosed in U.S. Pat. No. 6,108,853 to Dittus, which includes a cylindrical rotatable beater brush having a plurality of extending resilient bristles and prongs that physically beat the carpet as the nozzle head is moved.

Another example is disclosed in U.S. Pat. No. 6,161,251 to Lee et al., which uses a mechanical vibration generating device that vibrates using air sucked though a supplementary suction hole to beat the carpet. In various embodiments, the vibration generating device can be used to vibrate the nozzle body which in turn vibrates the surface to be cleaned or the vibration generating device can directly beat the surface.

However, one disadvantage of a mechanical beater is damage to the surface being cleaned. Sonic beaters were developed, which rely on fluctuation in air flow through the nozzle opening to dislodge dirt particles. For example, U.S. Pat. No. 2,932,054 to Lichtgarn discloses a vacuum cleaner in which the vibration of disks produces a vibrating column of air that loosens dirt in a carpet. Similarly, U.S. Pat. No. 5,400,466 to Alderman et al. discloses an air vibration suction nozzle that includes a speaker that vibrates the suction air and a means for adjusting the frequency and amplitude of the airwaves produced by the speaker.

Although sonic beaters avoid physical damage to a carpet often caused by mechanical beaters, they are not as effective in dislodging dirt on the surface of a carpet pile. At the same time, mechanical beaters are not as effective in removing particles embedded deeply in the carpet pile. Also, mechanical beaters tend to push dirt particles down into the carpet, thereby making it more difficult to effectively clean the carpet.

U.S. Pat. Nos. 7,143,470 and 7,225,505, both to applicant, disclose vacuum cleaners having both mechanical and sonic beaters. However, such vacuum cleaners have a single suction inlet associated with the mechanical and sonic beaters. Thus, the dirt and debris loosened by the sonic beater is drawn in through the single suction inlet associated with the mechanical and sonic beaters. Additionally, these patents do not disclose a suction path through the sonic beater. Accordingly, a need exists for a vacuum cleaner having suction inlets at both the mechanical and the sonic beaters.

SUMMARY OF THE INVENTION

A vacuum cleaner in accordance with exemplary embodiments of the present invention provides a suction inlet at both the mechanical and sonic beater assemblies. Dirt and debris loosened by the sonic beater assembly can be collected by a suction inlet associated with the sonic beater assembly, thereby increasing the efficiency of the vacuum cleaner.

The vacuum cleaner has a first suction inlet associated with the mechanical beater assembly and a second suction inlet associated with the sonic beater assembly, thereby improving the cleaning efficiency of the vacuum cleaner.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the attachment assembly, and are not intended to limit the structure of the attachment assembly to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF AN EXEMPLARY EMBODIMENT

Figure 1:
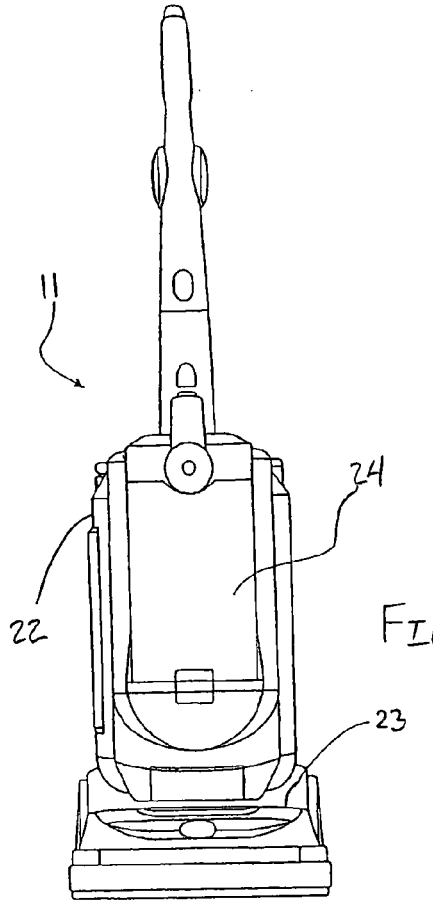
FIG. 1 is a front elevational view of a vacuum cleaner in accordance with an exemplary embodiment of the present invention.

As shown in FIGS. 1-18, a dual suction vacuum cleaner 11 in accordance with exemplary embodiments of the present invention includes a vibrating member 13 to facilitate removing dirt and debris from a surface to be cleaned. A first suction inlet 15 is associated with a mechanical beater 17 and a second suction inlet 19 is associated with the vibrating member 13 to improve the cleaning efficacy of the vacuum cleaner 11. The vacuum cleaner 11 can be any type of device employing suction to clean, including, but not limited to, upright, canister and handheld vacuum cleaners.

Figure 2:
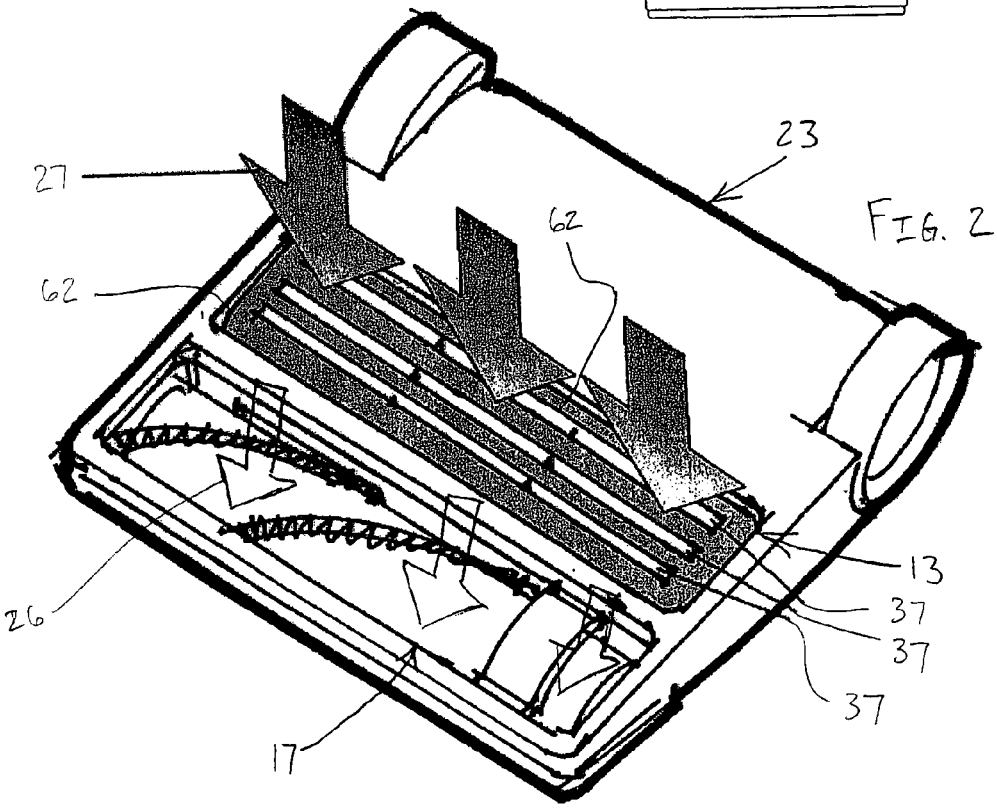
FIG. 2 is a perspective view of a vacuum cleaner in accordance with an exemplary embodiment of the present invention in which a first suction inlet is associated with a mechanical beater assembly and a second suction inlet is associated with a sonic beater assembly.
Figure 6:
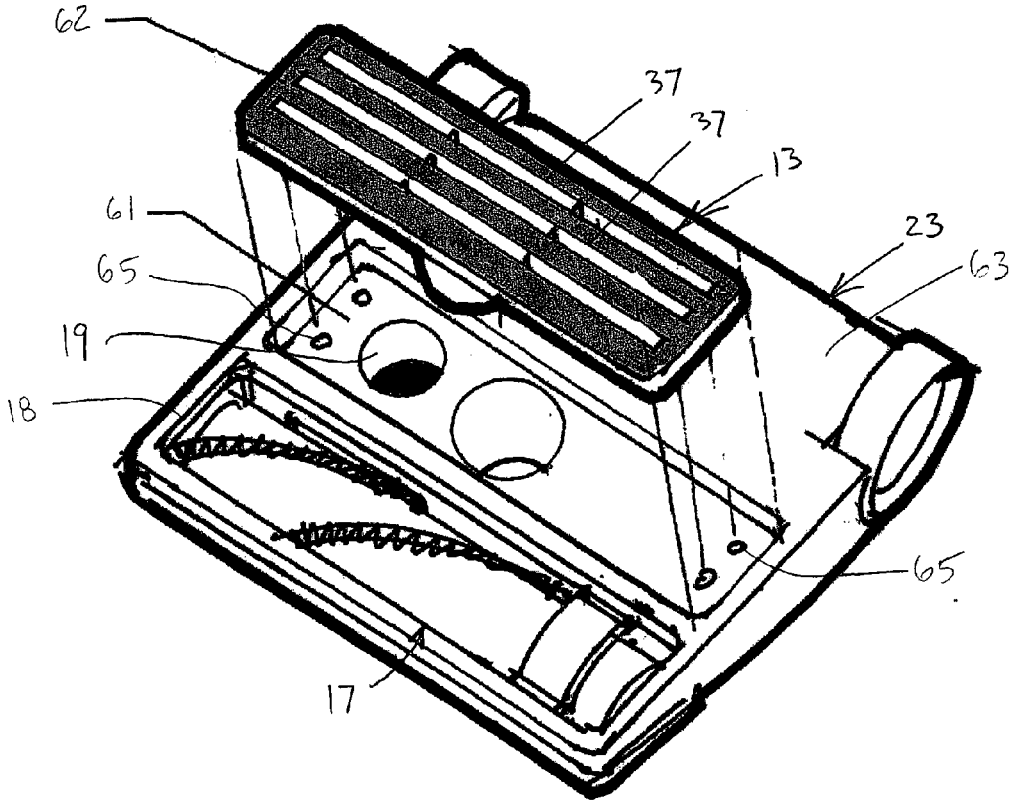
FIG. 6 is a perspective view of the vacuum cleaner with the sonic beater removed.
Figure 7:
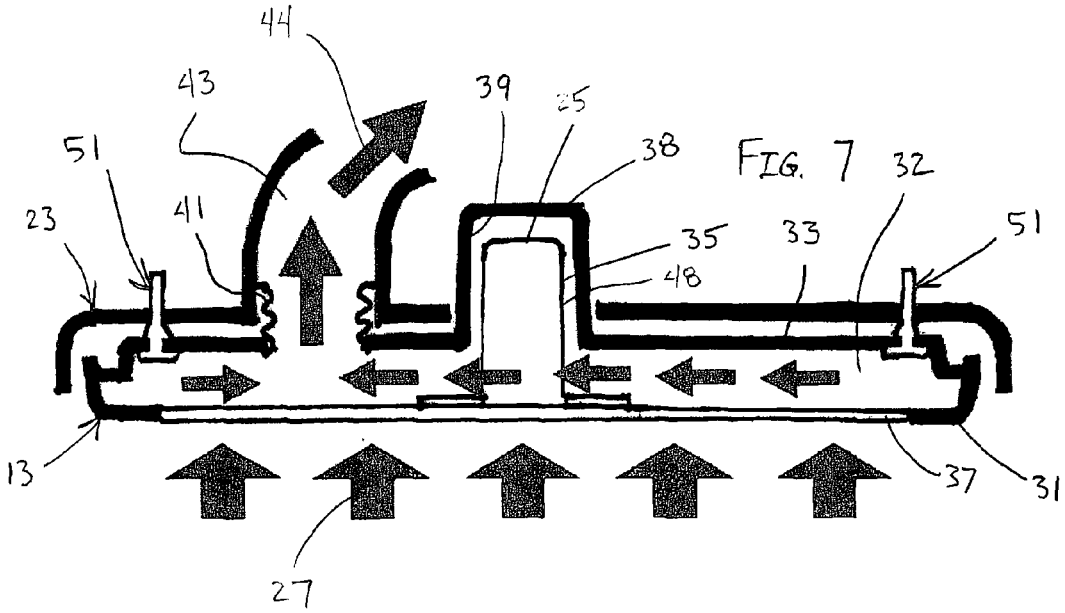
FIG. 7 is an elevational view in cross section of the sonic beater assembly illustrating airflow therethrough.
Figure 8:
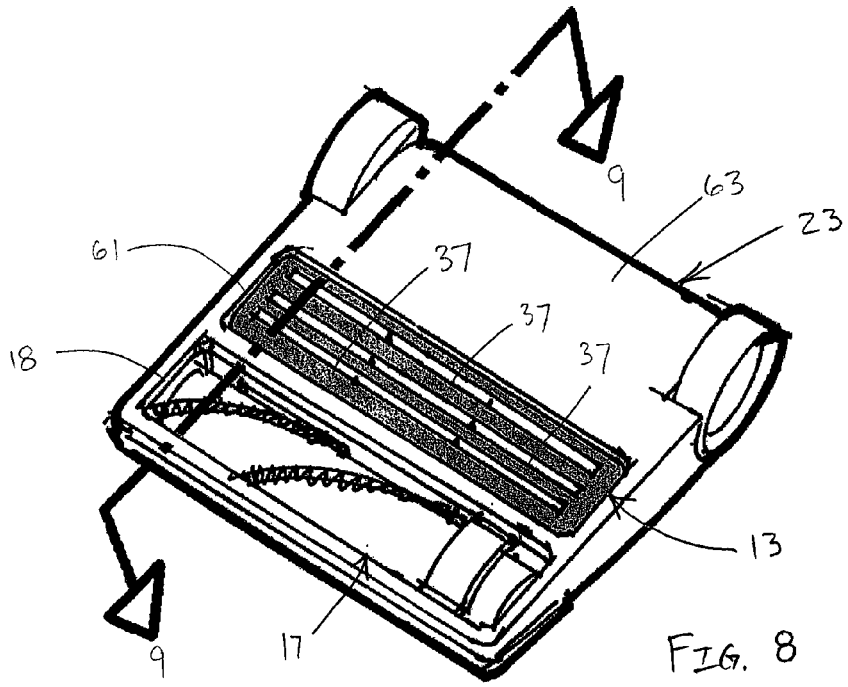
FIG. 8 is a perspective view of the mechanical beater assembly and the sonic beater assembly of the vacuum cleaner.
Figure 9:
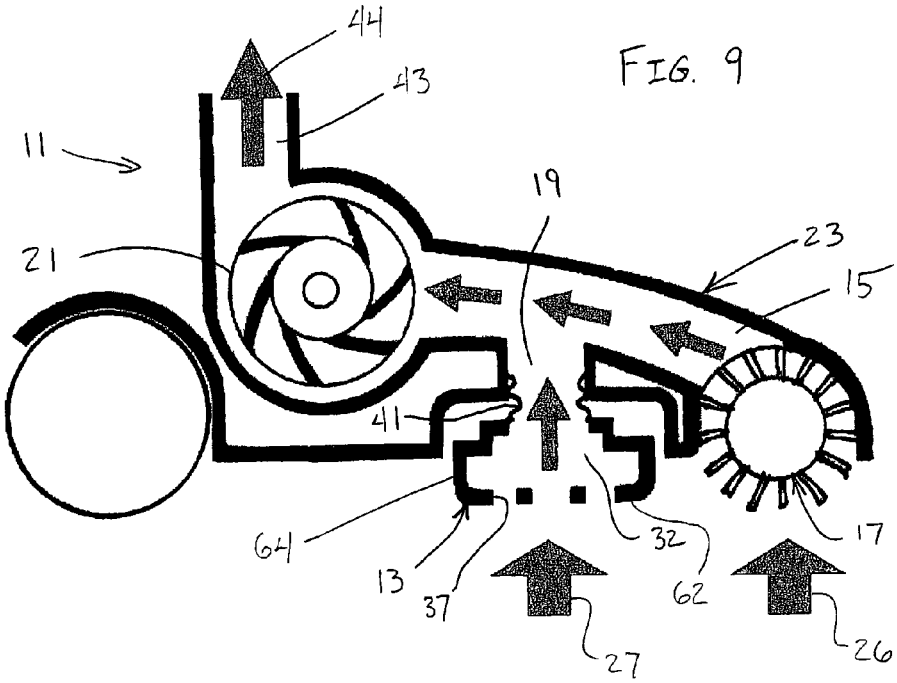
FIG. 9 is a side elevational view in cross section taken along line 9-9 of FIG. 8 of the base of the vacuum cleaner illustrating the first and second suction inlets.
Figure 10:
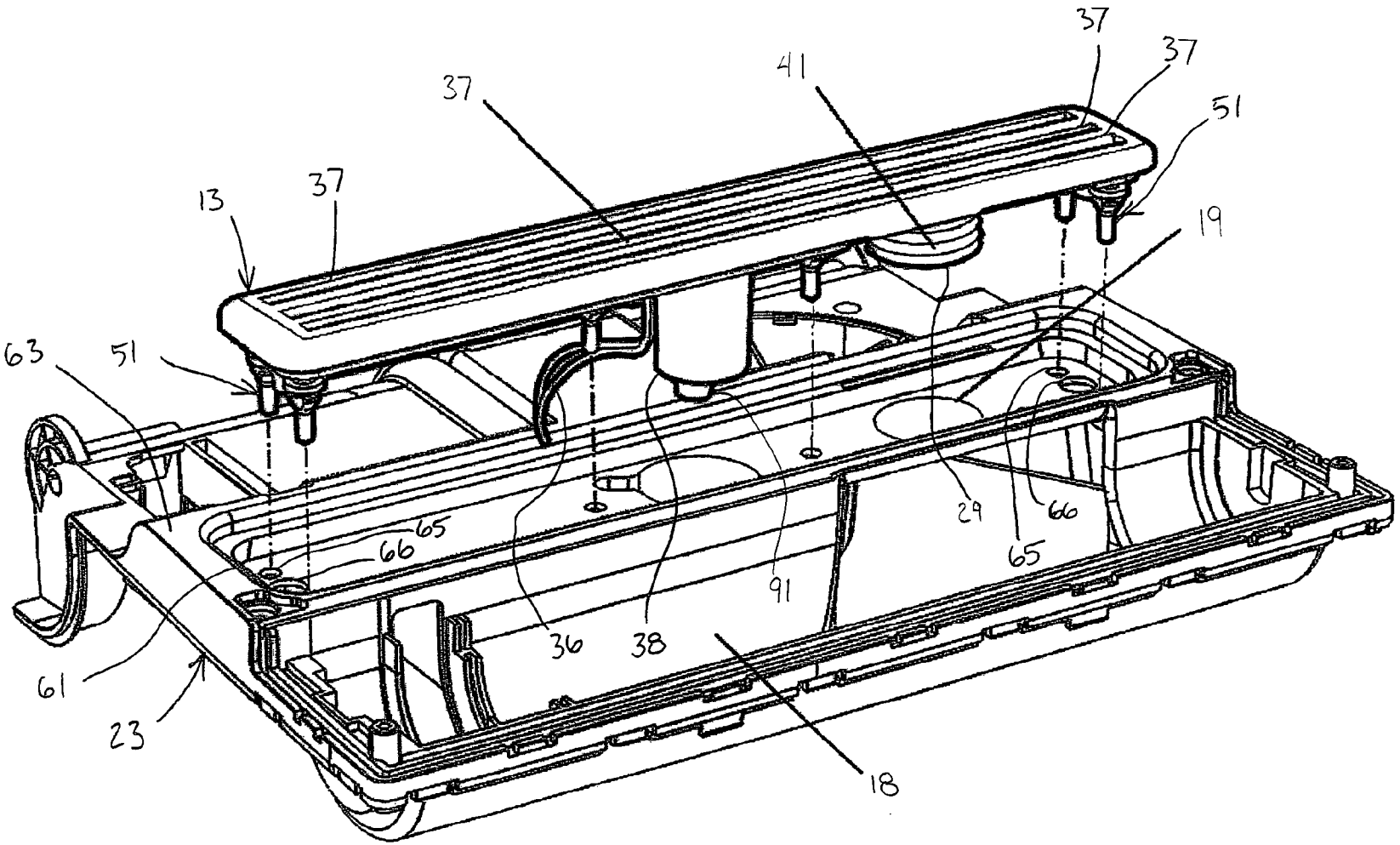
FIG. 10 is an exploded perspective view of the vacuum cleaner base and the sonic beater assembly with the mechanical beater assembly removed.
Figures 11, 12, 13, 14, 15, 16:
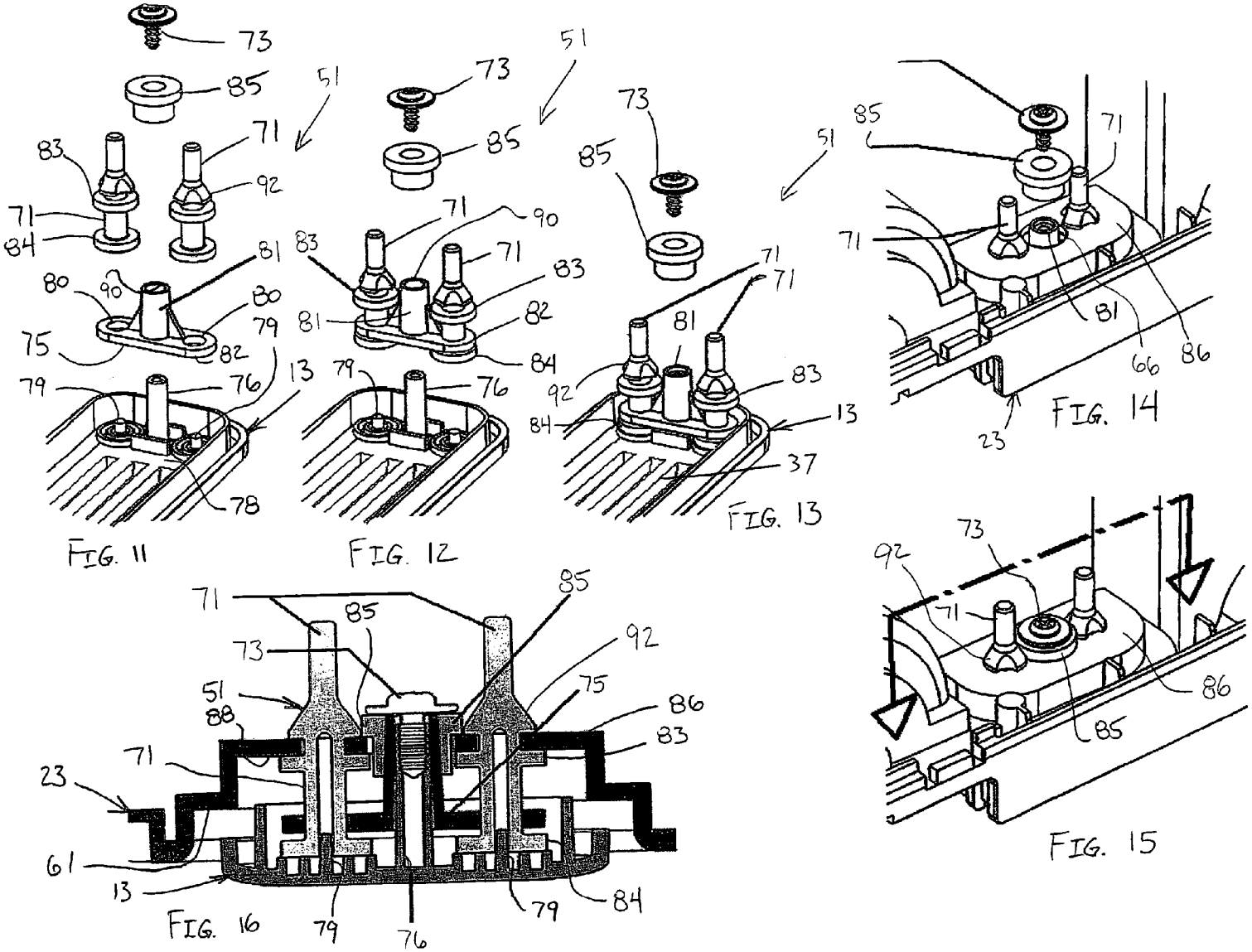
FIG. 11 is an exploded perspective view of a suspension mounting bracket of the sonic beater assembly.
FIG. 12 is an exploded perspective view of a partially assembled suspension mounting bracket of FIG. 11.
FIG. 13 is an exploded perspective view of the suspension mounting bracket partially connected to the sonic beater assembly.
FIG. 14 is a perspective view of the suspension mounting bracket partially connected to the base of the vacuum cleaner.
FIG. 15 is a perspective view of the sonic beater assembly connected to the base of the vacuum cleaner.
FIG. 16 is an elevational view in cross section of the sonic beater assembly connected to the base of the vacuum cleaner.

A suction motor 21 is disposed in a base 23 of the vacuum cleaner 11, as shown in FIGS. 1 and 9. Alternatively, the suction motor 21 can be disposed in the body 22 of the vacuum cleaner 11 or in any other suitable location. The suction motor 21 generates a suction force, as shown in FIGS. 2, 7 and 9, at the first and second suction inlets 15 and 19 in the base 23. The first suction inlet 15 draws through the mechanical beater, such as a brush roll 17, as indicated by arrow 26 in FIGS. 2 and 9. As shown in FIGS. 6, 8 and 11, the brush roll 17 is preferably disposed in a recess 18 in a lower surface 63 of the base 23. The second suction inlet 19 draws through the vibrating member 13, such as a sonic bar assembly, as indicated by arrow 27 in FIGS. 2, 7 and 9. Although shown with one suction motor, the vacuum cleaner can have separate suction motors for each suction inlet. Additionally, each suction inlet can have a separate flow path to the debris collector.

Figure 3:
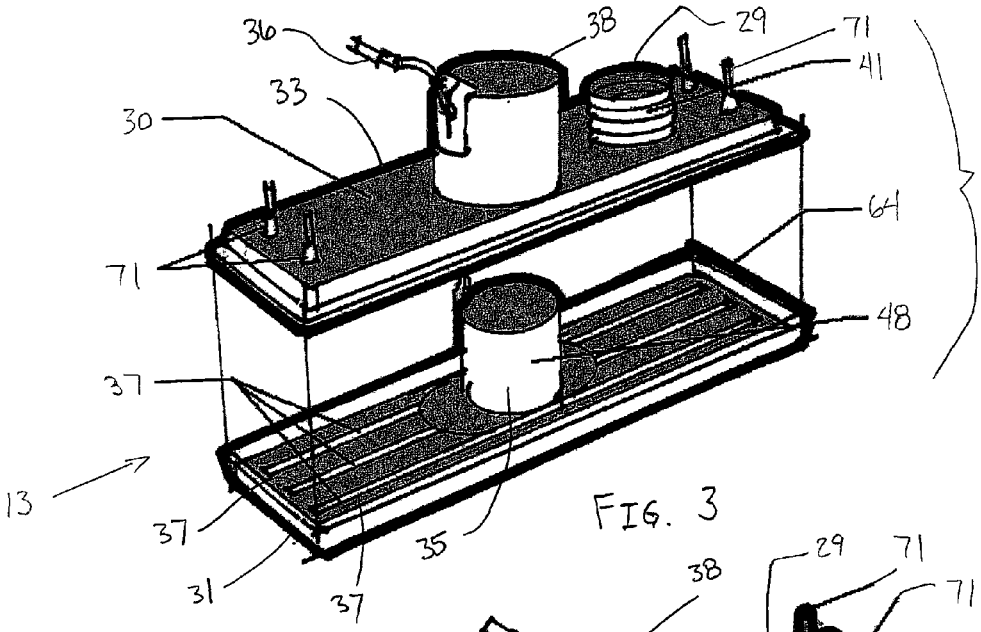
FIG. 3 is an exploded perspective view of the sonic beater assembly of FIG. 2.
Figure 4:
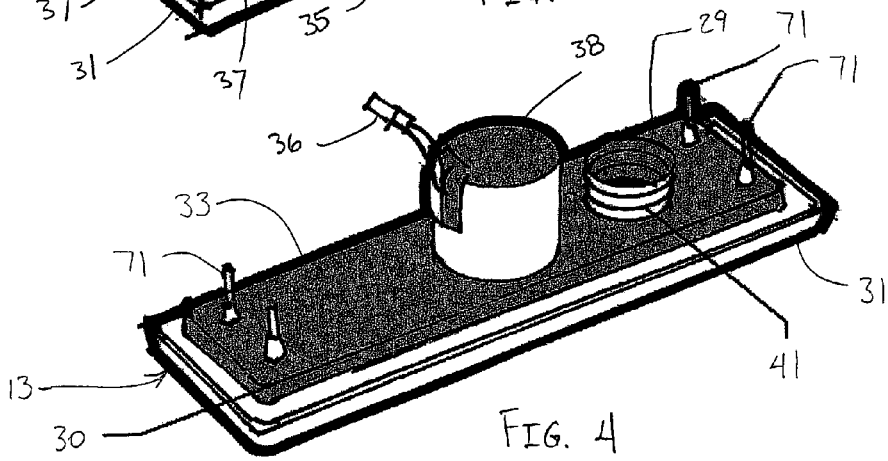
FIG. 4 is a perspective view of the sonic beater assembly of FIG. 3.
Figure 5:
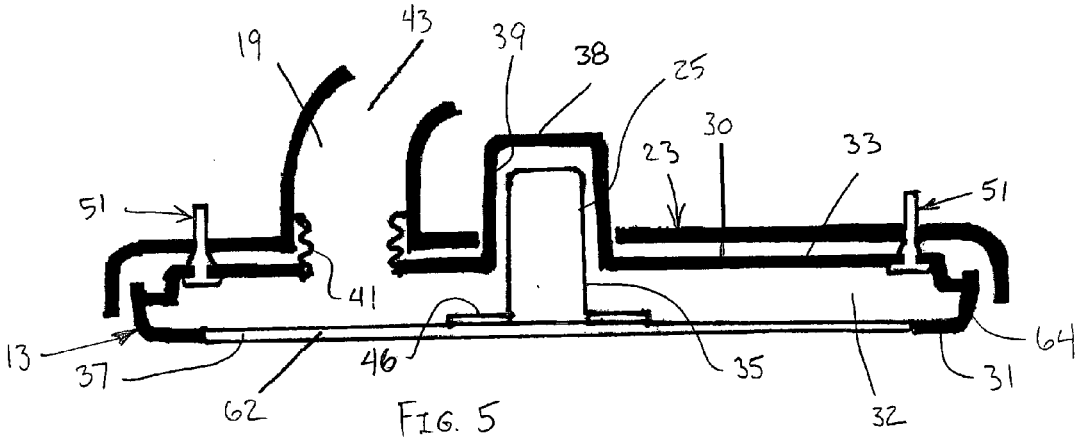
FIG. 5 is an elevational view in cross section of the sonic beater assembly of FIG. 4.

The vibrating member 13 includes a lower housing 31 connected to an upper housing 33, as shown in FIGS. 3-5, to form an airtight cavity 32 therebetween. A motor 35 is connected to the lower housing 31 and electrically connected by wires 36 to a power supply. An enclosure 38 in the upper housing 33 receives the motor 35 when the upper and lower housings 31 and 33 are connected together. The wires 36 pass through an opening in the enclosure 38 and are electrically connected to the motor 35. The motor 35 vibrates the vibrating member 13 when power is supplied thereto. Preferably, an outer surface 48 of the motor 35 is spaced from an inner surface 39 of the enclosure 38, as shown in FIGS. 5 and 7.

Figure 17:
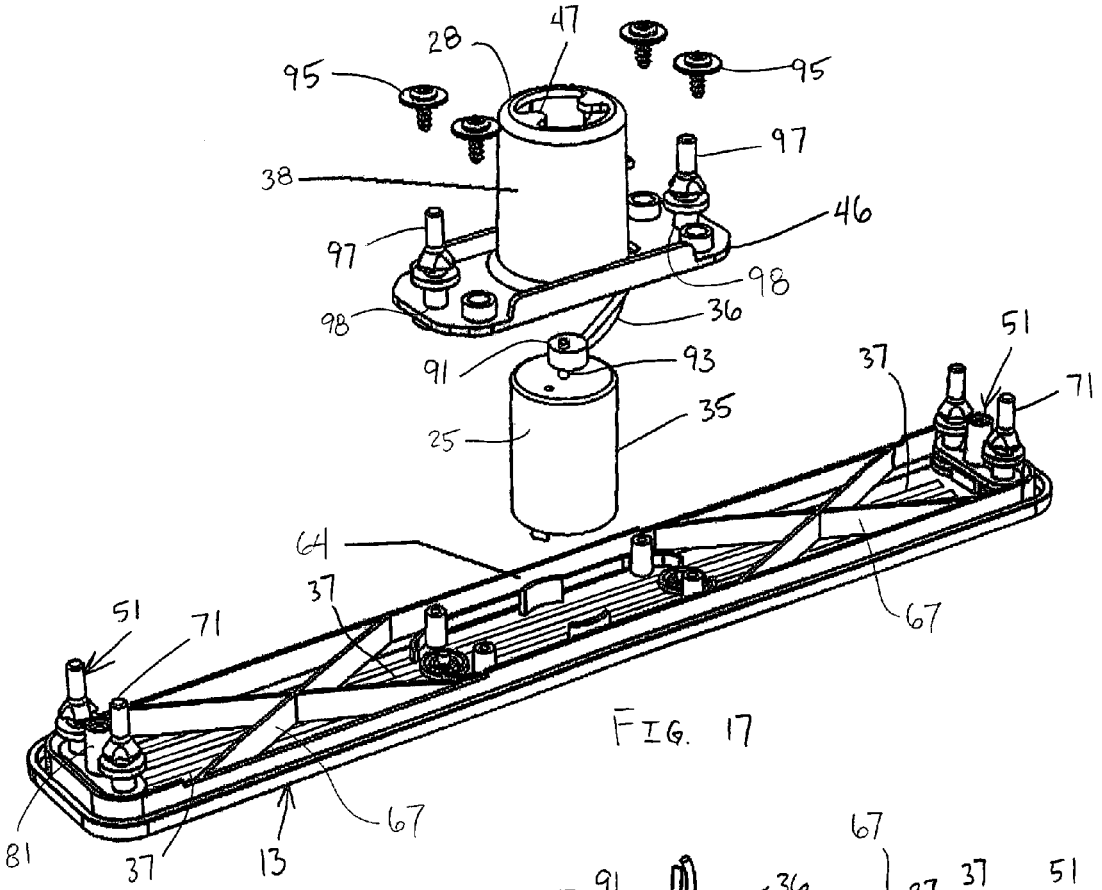
FIG. 17 is an exploded perspective view of the vibration motor and vibrating member.
Figure 18:
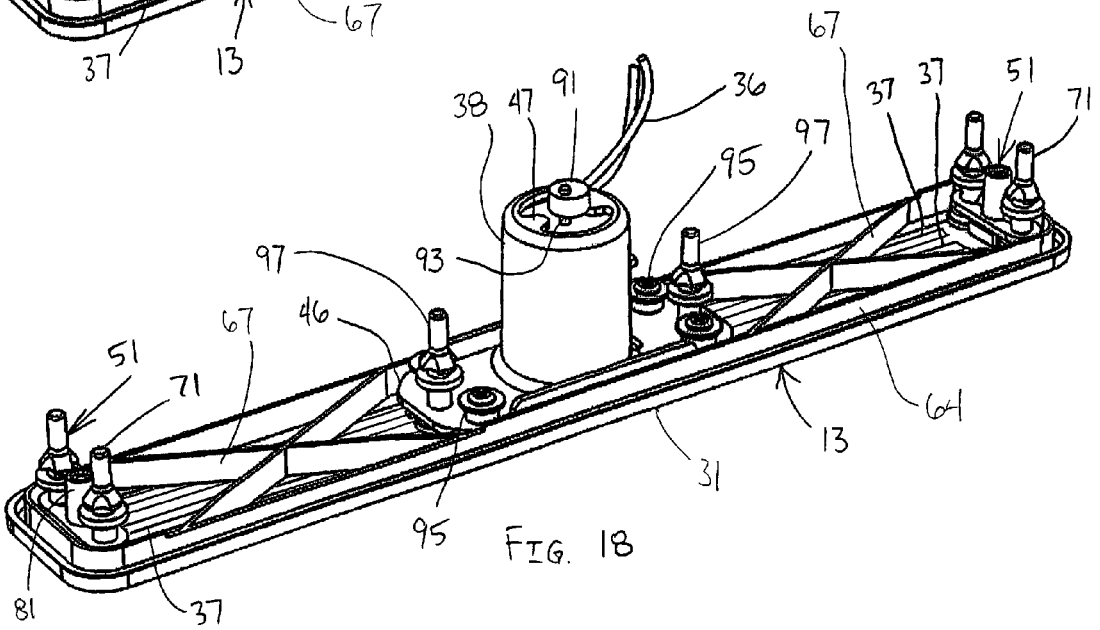
FIG. 18 is a perspective view of the assembled vibration motor and vibrating member of FIG. 17.

The motor 35 is fixed to the vibrating member 13, as shown in FIGS. 5, 17 and 18. Preferably, the motor 35 is fixed by a bracket 46 to the lower housing 31. An off-center weight 91 is disposed on a motor shaft 93 to introduce a vibration when the shaft 93 rotates, as shown in FIGS. 17 and 18. An opening 47 in the housing enclosure 38 allows the off-center weight 91 and motor shaft 93 to pass through an upper end 28 of the enclosure 38. The vibration of the motor shaft 93 causes the motor 35 to vibrate due to the off-center weight 91. The vibration of the motor 35 is transferred to the lower housing 31 through the bracket 46. Fasteners 95 secure the bracket 46 to the vibrating member 13. A plurality of suspension members 51 isolate the vibrating member 13 from the base 23 of the vacuum cleaner 11 such that the vibrations are not transferred to the base. Suspension mounts 97, which are substantially similar to posts 71, connect the bracket 46 to the base 23.

A plurality of slots 37 are disposed in a lower surface 62 of the lower housing 31 to allow air to be drawn in through the slots 37 to the second suction inlet 19. Preferably, the slots 37 extend longitudinally across the lower surface 62 of the lower housing 31, as shown in FIG. 2, although the slots can have any suitable shape or configuration. As shown in FIGS. 17 and 18, a wall 64 extends upwardly from the lower surface 62 of the lower housing 31. A plurality of stiffening members 67 are connected to the wall 64 to strengthen the vibrating member 13, as shown in FIGS. 17 and 18.

A flexible connector 41 connects the cavity 32 to the second suction inlet 19. As shown in FIGS. 5 and 7, the flexible connector 41 extends from the cavity 32 of the vibrating member 13 to the second suction inlet 19 in the base 23. An upper end 29 of the flexible connector 41 is disposed externally of the vibrating member 13 to facilitate connecting to the second suction inlet 19.

The first suction inlet 15 is associated with the mechanical beater 17, as shown in FIG. 9. The second suction inlet 19 is associated with the vibrating member 13. Accordingly, the second suction inlet 19 can draw dirt and debris loosened by the vibrating member 13 through the slots 37 therein without passing through the first suction inlet 15 associated with the mechanical beater 17. The first and second suction inlets 15 and 19 are in fluid communication with the vacuum air path 43, which is in fluid communication with a filter bag, dust bin or any other suitable debris collector. The flow through the air path 43 is indicated by arrow 44, as shown in FIGS. 7 and 9. The filter bag is preferably disposed in an outer housing 24, as shown in FIG. 1.

A plurality of suspension assemblies 51 connect the vibrating member 13 to the base 23 of the vacuum cleaner 11, as shown in FIGS. 10-16, to allow the vibrating member 13 to vibrate with respect to the base 23 of the vacuum cleaner 11. The suspension assemblies 51 substantially vibrationally isolate the vibrating member 13 from the base 23 of the vacuum cleaner 11, thereby preventing vibrations of the vibrating member 13 from being transferred to the base 23 of the vacuum cleaner 11. A recess 61 in a lower surface 63 of the base 23 of the vacuum cleaner 11 receives the vibrating member 13, as shown in FIG. 6, such that an upper surface 30 of the upper housing 33 is adjacent the recess 61. Preferably, the recess 61 is disposed rearwardly of the mechanical beater recess 18. A plurality of first openings 65 in the recess 61 receive posts 71 of the suspension members and a plurality of second openings 66 in the recess 61 receive retaining members 73 of the suspension assembly 51.

The suspension assembly 51 includes a suspension bracket 75, two posts 71 and a retaining member 73, as shown in FIGS. 11-13. The bracket 75 has a pair of openings 80 disposed in a base 82. A protrusion 81 extends upwardly from the base 82 between the pair of openings 80. An opening 90 is disposed in a free end of the protrusion 81.

The posts 71 are substantially identical, as shown in FIG. 11. The post 71 includes an upper flange 83 axially spaced from a lower flange 84. An enlarged head portion 92 is axially spaced from the upper flange 83 such that the upper flange 83 is disposed between the enlarged head portion 92 and the lower flange 84. Preferably, the post 71 is made of a soft, flexible silicone, although any suitable material can be used. The post 71 is preferably a single, one-piece member.

The two posts 71 are inserted through the pair of openings 80 in the base 82 of the suspension bracket 75 such that the upper and lower flanges 83 and 84 of the post 71 are disposed on opposite sides of the base 82 of the suspension bracket 75, as shown in FIGS. 12, 13 and 16. The enlarged head portion 92 and the upper flange 83 are inserted through the opening 80 in the base 82. The posts 71 are made of a flexible material to allow the enlarged head portion 92 and the upper flange 83 to pass through the opening 80 without losing or distorting their original shape.

The suspension bracket 75 is received by a first protrusion 76 extending outwardly from an inner surface 78 of the vibrating member 13. A pair of second protrusions 79 extend outwardly from the inner surface 78 on opposite sides of the first protrusion 76. The first protrusion 76 is received by the bracket protrusion 81 and the second protrusions 79 are received by the lower flanges 84 of the posts 75.

The posts 71 and the protrusion 81 of the suspension bracket 75 are passed through the first and second openings 65 and 66 in the recess 61, respectively, as shown in FIGS. 14 and 16. The upper flange 83 abuts an inner surface 88 of the base 23 when the posts 71 are fully inserted through the openings 65 in the base 23. A retaining bushing 85 is secured to the suspension bracket protrusion 81 by the retaining member 73, as shown in FIG. 15. The retaining bushing 85 and the retaining member 73 are connected to the suspension assembly 51 from an upper side 86 of the base 23, as shown in FIGS. 14-16. An outer surface of the retaining bushing 85 engages the opening 66 in the base 23 and an inner surface of the retaining bushing 85 receives the bracket protrusion 81. The retaining member 73 engages the first protrusion 76 of the lower housing 31 to further secure the vibrating member 13 to the base 23 of the vacuum cleaner 11. Preferably, the bushing 85 is made of silicone. The suspension assembly 51 isolates the vibration of the vibrating member 13 from the base 23 of the vacuum cleaner 11.

As shown in FIGS. 17 and 18, a suspension assembly 51 is disposed at each end of the vibrating member 13. Additionally, suspension mounts 97 are disposed on opposite sides of the motor enclosure 38 to further vibrationally isolate the vibrating member 13 from the base 23 of the vacuum cleaner 11. The suspension mounts 97 are substantially similar to the suspension posts 71, and are inserted through openings 98 in the bracket 46. Alternatively, as shown in FIGS. 3, 4 and 6, only suspensions posts 71 disposed at opposite ends of the vibrating member 13 secure the vibrating member 13 to the base 23.

While advantageous embodiments have been chosen to illustrate the invention, it will be understood by those skilled in the art that various changes and modifications may be made therein without departing from the scope of the invention as defined in the appended claims and their equivalents.

What is claimed is:

1. A vacuum cleaner, comprising:
a base;
a mechanical beater connected to said base;
a vibrating member connected to said base;
a first suction inlet in said base associated with said mechanical beater;
a second suction inlet in said base associated with said vibrating member; and
a plurality of openings disposed in said vibrating member to allow air to be drawn through said second suction inlet.

2. The vacuum cleaner according to claim 1, wherein said mechanical beater is a brush roll.

3. The vacuum cleaner according to claim 1, wherein a plurality of dampening members connect said vibrating member to said base to vibrationally isolate said vibrating member from said base.

4. The vacuum cleaner according to claim 1, wherein a motor connected to said vibrating member vibrates said vibrating member.

5. The vacuum cleaner according to claim 1, wherein said plurality of openings comprise a plurality of slots.

6. The vacuum cleaner according to claim 4, wherein a weight connected to a shaft is rotated by said motor.

7. The vacuum cleaner according to claim 6, wherein said shaft is spaced from a center of said weight.

8. The vacuum cleaner according to claim 1, wherein said first and second suction inlets are disposed upstream of a suction motor.

9. The vacuum cleaner according to claim 3, wherein said dampening member includes a bracket and first and second posts connected thereto.

10. The vacuum cleaner according to claim 9, wherein said first and second posts are received by openings in said base such that a flange is disposed on a first side of said base and an enlarged portion is disposed on a second side thereof.

11. The vacuum cleaner according to claim 10, wherein a fastener inserted from said second side of said base secures said vibrating member thereto.

12. The vacuum cleaner according to claim 5, wherein a flexible connector fluidly connects said vibrating member to said second suction inlet.

13. A vacuum cleaner, comprising:
a base;
at least one suction motor disposed in said base;
a mechanical beater connected to said base;
a vibrating member connected to said base;
a first suction inlet in said base associated with said mechanical beater through which air is drawn;
a second suction inlet in said base associated with said vibrating member through which air is drawn;
a plurality of openings disposed in said vibrating member to allow air to be drawn through said second suction inlet; and
at least one airflow path in fluid communication with at least one of said first and second suction inlets, said at least one airflow path flowing through said at least one suction motor to a debris collector.

14. The vacuum cleaner according to claim 13, wherein said mechanical beater is a brush roll.

15. The vacuum cleaner according to claim 13, wherein a plurality of dampening members connect said vibrating member to said base to vibrationally isolate said vibrating member from said base.

16. The vacuum cleaner according to claim 13, wherein a motor connected to said vibrating member vibrates said vibrating member.

17. The vacuum cleaner according to claim 13, wherein said plurality of openings comprise a plurality of slots.

18. The vacuum cleaner according to claim 17, wherein a weight connected to a shaft is rotated by said motor, said shaft being spaced from a center of said weight.

19. The vacuum cleaner according to claim 15, wherein said dampening member includes a bracket and first and second posts connected thereto.

20. The vacuum cleaner according to claim 19, wherein said first and second posts are received by openings in said base such that a flange is disposed on a first side of said base and an enlarged portion is disposed on a second side thereof.

* * * * *